US005951847A

United States Patent [19]

Grandvallet et al.

[11] Patent Number: 5,951,847

[45] **Date of Patent: *Sep. 14, 1999**

[54] CATALYTIC DEHAZING OF LUBRICATING BASE OILS

[75] Inventors: Pierre Grandvallet; Laurent Georges Huve, both of Grand Couronne, France

[73] Assignee: Shell Oil Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,504

[22] Filed: Oct. 31, 1996

[30] Foreign Application Priority Data

Nov. 9, 1995 [EP] European Pat. Off. ..... 95402515

[51] Int. Cl.[6] ..... C10G 45/00

[52] U.S. Cl. ..... 208/27; 208/46; 208/264; 208/14; 208/18; 208/28; 208/33; 208/111; 585/737; 585/739

[58] Field of Search ..... 208/111, 27, 28, 208/33, 18, 46, 264; 585/737, 734

[56] References Cited

U.S. PATENT DOCUMENTS

| | | | |
|---|---|---|---|
| 3,933,974 | 1/1976 | Winquist | 423/329 |
| 4,017,590 | 4/1977 | Cormier et al. | 423/118 |
| 4,088,739 | 5/1978 | Vaughan et al. | 423/118 |
| 4,269,695 | 5/1981 | Silk et al. | 208/111 |
| 4,335,019 | 6/1982 | Bowes et al. | 208/120 |
| 4,343,692 | 8/1982 | Winquist | 201/111 |
| 4,388,177 | 6/1983 | Bowes et al. | 208/111 |
| 4,428,819 | 1/1984 | Shu et al. | 208/46 |
| 4,853,203 | 8/1989 | Guth et al. | 423/328 |
| 4,867,862 | 9/1989 | Ziemer | 208/27 |
| 5,118,482 | 6/1992 | Narayana | 423/328 |
| 5,157,191 | 10/1992 | Bowes et al. | 585/533 |
| 5,242,676 | 9/1993 | Apelian et al. | 423/714 |
| 5,523,510 | 6/1996 | Pellet et al. | 585/67 |

*Primary Examiner*—Helane Myers

[57] ABSTRACT

A process for catalytically dehazing lubricating base oils is disclosed, which comprises contacting the lubricating base oil in the presence of hydrogen with a catalyst comprising naturally occurring and/or synthetic ferrierite which ferrierite has been modified to reduce the mole percentage of alumina and a low acidity refractory oxide binder material which is essentially free of alumina.

10 Claims, No Drawings

CATALYTIC DEHAZING OF LUBRICATING BASE OILS

FIELD OF THE INVENTION

The present invention relates to a process for catalytically dehazing lubricating base oils.

BACKGROUND OF THE INVENTION

The occurrence of haze in lubricating base oils which are stored for some time is a generally recognised problem. Both solvent dewaxed and catalytically dewaxed lubricating base oils are known to produce haze after having been stored for some time. The haze is thought to be caused by traces of high melting waxy molecules, particularly linear and slightly branched paraffins, which are still left in the base oil after the dewaxing treatment. It will be appreciated that the occurrence of haze makes the lubricating base oils less commercially attractive.

Several methods have been proposed in the art to deal with the problem of haze.

For instance, in U.S. Pat. No. 4,269,695 a catalytic dehazing process is disclosed, wherein contaminated dewaxed lube base stock oil is contacted in the presence of hydrogen with a catalyst comprising a hydrogenation component, suitably nickel, and an aluminosilicate zeolite having a silica/alumina molar ratio of at least 12. Suitably, the zeolite should also have a framework density of more than 1.6 g/ml and a constraint index of from 1 to 12. An inorganic porous matrix material may also be present and the preferred material for this purpose is alumina.

In U.S. Pat. No. 4,428,819 a catalytic dehazing process is disclosed, wherein dehazing is accomplished by isomerisation of the waxy molecules which are held responsible for the haze formation. To this end the lubricating base oil feed is contacted in the presence of hydrogen with a catalyst comprising a hydrogenation component, suitably a noble metal-based one, and a crystalline zeolite having high structural silica to alumina molar ratios, i.e. 50:1 or higher. The background of this patent is that the isomerisation reaction only requires a relatively small degree of acidic functionality. Higher degrees of acidic functionality would only favor the undesired cracking reactions. Crystalline zeolites in a highly siliceous form should, accordingly, be used. In addition to the hydrogenation component and the crystalline zeolite a porous inorganic refractory oxide binder material, preferably alumina, may be present as well. Hydroisomerisation conditions involve a temperature of from 200 to 450° C. and a pressure of from 4 to 250 bar. The process is particularly suitable for dehazing catalytically dewaxed base oils having a boiling point above 345° C.

In U.S. Pat. No. 4,867,862 a process is disclosed wherein a multilayered catalyst system is used for hydrodehazing and hydrofinishing a hydrocracked, solvent dewaxed lubricating base oil. The hydrodehazing catalyst should have a high selectivity for normal paraffins as related to branched paraffins and may be selected from the catalysts conventionally applied in catalytic dewaxing processes. The use of a catalyst comprising a silicoaluminophosphate (SAPO) is preferred. The hydrodehazing catalysts may suitably comprise a porous inorganic refractory oxide—alumina being preferred—and may or may not contain a hydrogenation component. The liquid hourly space velocity in the hydrodehazing step should be high, i.e. greater than 4 $hr^{-1}$, while temperature and pressure are about 290 to 345° C. and greater than about 35 bar, respectively.

Although the prior art processes described above may perform satisfactorily in many respects, there is still room for improvement. The present invention, accordingly, aims to provide a process for catalytically dehazing those lubricating base oils suffering from a haze problem when stored for some time in an effective way. The present invention also aims to provide a catalytic dehazing process which can be carried out at relatively mild conditions. Furthermore, the present invention aims to provide a catalytic dehazing process which can be readily integrated with existing dewaxing operations, such as catalytic dewaxing and solvent dewaxing operations.

BRIEF DESCRIPTION OF THE INVENTION

Accordingly, the present invention relates to a process for catalytically dehazing lubricating base oils, which process comprises contacting the lubricating base oil in the presence of hydrogen with a catalyst comprising naturally occurring and/or synthetic ferrierite, which ferrierite has been modified to reduce the mole percentage of alumina, and a low acidity refractory oxide binder material, which is essentially free of alumina.

DESCRIPTION OF THE INVENTION

The lubricating base oil used as the feed in the present process is a dewaxed lubricating base oil having an initial boiling point of at least 350° C., a VI of at least 85 and a kinematic viscosity at 100° C. (Vk100) of at least 25 centistokes (cSt, identical to $mm^2/s$), suitably at least 30 cSt. Accordingly, the feedstock is a heavier grade dewaxed base oil. Since particularly lubricating base oils obtained via catalytic dewaxing may suffer from the occurrence of haze, suitable feedstocks are catalytically dewaxed, heavier grade lubricating base oils. However, solvent dewaxed lubricating base oils which suffer from the occurrence of haze can also be suitably treated by the process according to the present invention.

The mole percentage of alumina present in the ferrierite is defined as the percentage of moles $Al_2O_3$ relative to the total number of moles of oxides constituting the ferrierite (prior to modification) or modified ferrierite (after modification). In other words, the mole percentage of alumina is the percentage of alumina moieties relative to the total number of oxide moieties constituting the ferrierite or modified ferrierite. The expression "alumina moiety" as used in this connection refers to an $Al_2O_3$-unit which is part of the framework of the ferrierite, i.e. which has been incorporated via covalent bindings with other oxide moieties, such as silica ($SiO_2$), in the framework of the ferrierite.

Modification of the ferrierite to reduce the mole percentage of alumina basically implies that the number of surface acid sites is reduced. This can be achieved in various ways. A first way is applying a coating of a refractory inorganic oxide which is essentially free of alumina (i.e. a low acidity inorganic refractory oxide) onto the surface of the crystallites of the ferrierite. Suitable inorganic oxides for this purpose are silica, zirconia or titania, of which silica is preferred. By applying such coating onto the crystallites' surface, the total number of oxide moieties in the modified ferrierite (i.e. the original ferrierite plus the coating) is increased, while the number of alumina moieties remains the same, thus resulting in a reduced mole percentage of alumina. A major advantage of this method is that the number of acid sites on the surface of the crystallites of the ferrierite is drastically reduced to essentially zero, thus avoiding the occurrence of immediate cracking of waxy molecules upon contact with the ferrierite. Instead, the high melting waxy molecules that are responsible for the haze, are allowed to penetrate into the crystallites, where they are selectively converted into waxy molecules having a lower melting point which do not cause any haze. In this way gas make is effectively suppressed, which is favorable for the final yield of useful products, such as naphtha, kerosine and gas oil.

Another very useful way of modifying the ferrierite is by subjecting it to a dealumination treatment. In general, dealumination of the ferrierite crystallites refers to a treatment, whereby aluminium atoms are either withdrawn from the ferrierite framework leaving a defect or are withdrawn and replaced by other atoms, such as silicon, titanium, borium, germanium or zirconium. Dealumination can be attained by methods known in the art. Particularly useful methods are those, wherein the dealumination is claimed to occur selectively at the surface of the crystallites of the ferrierite. In this way, namely, the same effect as with the coated ferrierite can be attained: the number of acid sites at the surface of the crystallites is reduced, so that the phenomenon of cracking reactions occurring as soon as waxy molecules come into contact with the crystallites can be significantly reduced, thereby allowing the waxy molecules responsible for the haze to enter the crystallites for the desired reactions to occur. As explained above, this positively influences the yield of both dewaxed product and useful by-products.

Modification of the ferrierite by subjecting it to a (surface) dealumination treatment is the preferred way of reducing its mole percentage of alumina.

In U.S. Pat. No. 5,157,191 a very suitable process for dealuminating the surface of an aluminosilicate zeolite is described wherein the zeolite is contacted with an aqueous solution of a hexafluorosilicate salt, most advantageously ammonium hexafluorosilicate, to extract the aluminium atoms located at the surface of the zeolite and replace these atoms with silicon atoms. In said U.S. patent, several hydrocarbon conversion reactions including shape-selective oligomerization of olefins to produce high viscosity lube oils, cracking, isomerization of xylene, disproportionation of toluene and alkylation of aromatics, are described in which the surface modified zeolite could be useful as a catalyst. However, no reference is made to catalytic dewaxing nor to loading the surface modified zeolite with a hydrogenation component.

Another method for dealuminating the surface of zeolite crystallites is disclosed in U.S. Pat. No. 5,242,676. According to this method a zeolite is contacted with a dicarboxylic acid, suitably in the form of an aqueous solution, for sufficient time to effect at least 40% reduction in surface acidity with less then 50% overall dealumination. A very suitable dicarboxylic acid is oxalic acid, while suitable zeolites should have a Constraint Index of greater than 1, thus including naturally occurring ferrierite as well as synthetic ferrierite (ZSM-35).

The dealumination of the aluminosilicate zeolite results in a reduction of the number of alumina moieties present in the zeolite and hence in a reduction of the mole percentage of alumina. A very good measure for the reduction of the mole percentage of alumina is the increase of the silica to alumina ($SiO_2/Al_2O_3$) molar ratio of the zeolite as a result of the dealumination treatment. For the purpose of the present invention, the dealumination ratio, which is defined as the ratio of $SiO_2/Al_2O_3$ molar ratio of surface dealuminated zeolite (i.e. after dealumination) to $SiO_2/Al_2O_3$ molar ratio of starting zeolite (i.e. before dealumination), is suitably in the range of from 1.1 to 3.0, preferably from 1.3 to 2.5 and even more preferably from 1.5 to 2.2. Selective dealumination of the surface of the ferrierite crystallites, accordingly, also results in a reduction of the number of surface acid sites of the ferrierite crystallites, while not affecting the internal structure of the zeolite crystallites. The extent of dealumination of the surface of the crystallites depends on the severity of the dealumination treatment. Suitably, the number of surface acid sites of the ferrierite is reduced with at least 70%, preferably with at least 80% and even more preferably with at least 90%. In a most preferred embodiment the number of surface acid sites is reduced with essentially 100% by the selective dealumination, thus leaving essentially no surface acid sites at all. Without wishing to be bound by any particular theory it is believed that due to the selective dealumination of the crystallite surface the acidity of the inner part of the crystallites remains substantially unaffected and that it is this particular configuration which results the excellent dehazing activity, selectivity and stability.

The crystallite size of the ferrierite is not particularly critical and may be as high as 100 micron. However, for an optimum catalytic activity it is preferred to employ ferrierite crystallites having a size of between 0.1 and 50 micron, more preferably between 0.2 and 20 micron, while very good results have been obtained with crystallites having a size of between 0.5 and 5 micron.

The dehazing catalyst composition used in the present process suitably also comprises a binder material which does not introduce acidity into the modified ferrierite. In case of a dealuminated ferrierite, this implies that the binder should not re-acidify the dealuminated surface of the ferrierite crystallites. Accordingly, if used at all, a binder should be used, which is essentially free of aluminium. A refractory inorganic oxide, which is essentially free of aluminium, is particularly suitable for this purpose. Suitable binder materials, then, include low acidity refractory oxides such as silica, zirconia, titanium dioxide, germanium dioxide, boria and mixtures of two or more of these. The most preferred binder, however, is silica. If present, the weight ratio of modified ferrierite to binder is suitably within the range of from about 10/90 to about 90/10, preferably from about 20/80 to about 80/20 and most preferably from about 50/50 to about 80/20.

In addition to the modified ferrierite and optionally the binder material, the catalyst composition may also comprise a hydrogenation component. If present, the hydrogenation component suitably comprises at least one Group VIB metal component and/or at least one Group VIII metal component. Group VIB metal components include tungsten, molybdenum and/or chromium as sulphide, oxide and/or in elemental form. If present, a Group VIB metal component is suitably present in an amount of from 1 to 35% by weight, more suitably from 5 to 30% by weight, calculated as element and based on total weight of support, i.e. modified ferrierite plus optional binder. Group VIII metal components include those components based on both noble and non-noble metals. Particularly suitable Group VIII metal components, accordingly, are palladium, platinum, nickel and/or cobalt in sulphidic, oxidic and/or elemental form. Group VIII non-noble metals, if present at all, may be present in an amount in the range of from 1 to 25% by weight, preferably 2 to 15% by weight, calculated as element and based on total weight of support. The total amount of Group VIII noble metal will normally not exceed 5% by weight calculated as element and based on total weight of support, and preferably is in the range of from 0.2 to 3.0% by weight. If both platinum and palladium are present, the weight ratio of platinum to palladium may vary within wide limits, but suitably is in the range of from 0.05 to 10, more suitably 0.1 to 5. Catalysts comprising palladium and/or platinum as the hydrogenation component are preferred.

Typical dehazing conditions suitably applied in the process according to the present invention involve a temperature in the range of from 200 to 350° C., preferably 210 to 290° C., and a hydrogen partial pressure in the range of from 2 to 150 bar, preferably 5 to 100 bar, more preferably 5 to 50 bar. The weight hourly space velocity (WHSV) to be applied is suitably in the range of from 0.1 to 10 kg of oil per liter of catalyst per hour (kg/l/hr), more suitably from 0.2 to 5 kg/l/hr and most suitably from 0.3 to 3 kg/l/hr and gas rates in the range of from 100 to 2,000 normal liters of hydrogen per kilogram of oil, more suitably in the range of from 200 to 1,500 Nl/kg.

The invention is further illustrated by the following examples which are provided for illustrative purposes and are not to be construed as limiting the invention.

EXAMPLE 1

A surface dealuminated ferrierite catalyst was prepared according to the following procedure. 3800 ml of a 0.11 N ammonium hexafluorosilicate solution were added to a zeolite-water slurry containing 120 grams of ferrierite ($SiO_2/Al_2O_3$ molar ratio of 11.7) and 1700 ml deionised water. The reaction mixture was heated to 100° C. and maintained at this temperature for one night. The product was washed with deionised water, dried for 2 hours at 120° C. and then calcined for 2 hours at 480°0 C. The surface dealuminated ferrierite thus obtained had a $SiO_2/Al_2O_3$ molar ratio of 22.3, so that the dealumination ratio was 1.9. Subsequently the surface dealuminated ferrierite was extruded with a silica binder (70% by weight of ferrierite, 30% by weight of silica binder). The extrudates were dried at 120° C. and calcined at 500° C.

A hazy, solvent dewaxed lubricating base oil having the properties listed in Table I was subsequently contacted with the surface dealuminated, silica-bound ferrierite catalyst in the presence of hydrogen (hydrogen partial pressure: 40 bar) at three different temperatures (240° C., 270° C. and 300° C.), a WHSV of 1 kg/l/hr and a gas rate of 700 Nl/kg. Solvent dewaxing was carried out using the conventional MEK/toluene mixture as the dewaxing solvent (MEK= Methyl Ethyl Ketone). The results in terms of Storage Stability (Stor.Stab.) are indicated in Table I.

The Storage Stability was measured by determining the number of days for the oil to produce a detectable change (deposits, haze, suspension), other than a change in color, when stored in the dark at 0° C. under an air blanket in a sealed test cylinder of transparent glass. A storage stability of less than 60 days is considered unacceptable.

TABLE I

Dehazing of solvent dewaxed lubricating base oil

| | | Product | | |
|---|---|---|---|---|
| | Feed | T = 240° C. | T = 270° C. | T = 300° C. |
| IBP (° C.) | 405 | 406 | 427 | 408 |
| 50% w BP (° C.) | 575 | 581 | 579 | 575 |
| 90% w BP (° C.) | 667 | 680 | 671 | 667 |
| Vk40 ($mm^2/s$) | 483 | 457 | 443 | 435 |
| Vk100 ($mm^2/s$) | 31.1 | 30.2 | 29.8 | 29.5 |
| VI | 94 | 95 | 95 | 96 |
| Stor. Stab. (days) | <2 | >60 | >60 | >60 |

Table I evidently shows that treating the dewaxed lubricating base oil with a surface dealuminated, silica-bound ferrierite catalyst in accordance with the present invention indeed significantly reduces the occurrence of haze.

EXAMPLE 2

A catalytically dewaxed lubricating base oil having the properties listed in Table II was subjected to the same dehazing treatment as described in Example 1, except that the dehazing temperature was 250° C. The same dehazing catalyst was used. Catalytic dewaxing was carried out according to the hydroisomerisation method disclosed in International patent application No. WO 90/09363. Storage stability of the dehazed product was determined in the same way as in Example 1. The results are listed in Table II.

TABLE II

Dehazing of catalytically dewaxed lubricating base oil

| | Feed | Product |
|---|---|---|
| Vk40 ($mm^2/s$) | 46.2 | 45.9 |
| Vk100 ($mm^2/s$) | 6.9 | 6.8 |
| VI | 104 | 104 |
| Stor. Stab. (days) | 5 | >60 |

From Table II it can be seen that treatment of a catalytically dewaxed lubricating base oil with a surface dealuminated, silica-bound ferrierite catalyst considerably increases the storage stability without deteriorating viscosity and VI of the lubricating base oil.

We claim:

1. A process for catalytically dehazing a lubricating base oil, which process comprises contacting a dewaxed lubricating base oil in the presence of hydrogen with a catalyst comprising naturally occurring ferrierite or a synthetic ferrierite or a combination of a natural and synthetic ferrierite, which ferrierite is modified to reduce the mole percentage of alumina, and a low acidity refractory oxide binder material which is essentially free of alumina.

2. The process of claim 1 wherein the ferrierite containing crystallites is modified by coating the ferrierite crystallites with a refractory inorganic oxide which is essentially free of alumina.

3. The process of claim 2 wherein the refractory inorganic oxide is silica.

4. The process of claim 1 wherein the ferrierite has been modified by subjecting the ferrierite to a dealumination treatment.

5. The process of claim 4 wherein the mutual ratio of the $SiO_2/Al_2O_3$ molar ratio of ferrierite after dealumination to the $SiO_2/Al_2O_3$ molar ratio of ferrierite before dealumination, ranges from 1.1 to 3.0.

6. The process of claim 1 wherein the catalyst comprises a hydrogenation component.

7. The process of claim 6 wherein the hydrogenation component comprises platinum or palladium or a combination of platinum and palladium.

8. The process of claim 1 wherein the process is carried out at a temperature in the range of from 200 to 350° C., and a hydrogen partial pressure in the range of from 2 to 150 bar.

9. The process of claim 1 wherein the refractory inorganic oxide is selected from the group consisting of silica, zirconia, titanium dioxide, germania, boria, and mixtures thereof.

10. The process of claim 9 wherein the refractory inorganic oxide is silica.

* * * * *